US006739732B2

(12) United States Patent
Tseng

(10) Patent No.: US 6,739,732 B2
(45) Date of Patent: May 25, 2004

(54) DOOR PLATE ASSEMBLY WITH SOLAR-POWERED LIGHTING UNIT

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/273,481

(22) Filed: Oct. 18, 2002

(65) Prior Publication Data

US 2004/0076013 A1 Apr. 22, 2004

(51) Int. Cl.[7] ..... F21L 4/00; B65D 91/00

(52) U.S. Cl. ..... 362/183; 362/155; 362/191; 232/17

(58) Field of Search ..... 362/155, 431, 362/183, 190, 191; 232/17, 36; 40/566, 611

(56) References Cited

U.S. PATENT DOCUMENTS 6,131,321 A * 10/2000 Daigle, Jr. ..... 40/612

6,513,284 B1 * 2/2003 Sandlin ..... 47/66.6

* cited by examiner

*Primary Examiner*—Sandra O'Shea
*Assistant Examiner*—Guiyoung Lee
(74) *Attorney, Agent, or Firm*—Ladas & Parry

(57) ABSTRACT

A door plate assembly includes an upright support unit having a lower end adapted to be disposed on a ground surface, a door plate mounted on the upright supports unit, a lighting unit mounted on the upright support unit and operable so as to generate a light output for illuminating the door plate, and a power source mounted on the upright support unit. The power source includes a solar panel that is adapted to convert solar energy to electrical energy, a battery unit that is coupled electrically to and that is charged by the electrical energy generated by the solar panel, and alighting controller connected electrically to the battery unit and the lighting unit. The lighting controller controls activation of the lighting unit.

8 Claims, 4 Drawing Sheets

DOOR PLATE ASSEMBLY WITH SOLAR-POWERED LIGHTING UNIT

BACKGROUND OF THE INVENTION

1. Field of the Invention

The invention relates to a door plate assembly, more particularly to a door plate assembly with a solar-powered lighting unit.

2. Description of the Related Art

Most residential houses in Europe and America have a front yard. In order to clearly indicate the house number, a door plate assembly is generally provided on the front yard of the house for mounting a door plate. A mail box may be integrated with the door plate assembly. It is noted that the door plate assembly is clearly visible only in day time. While a device for illuminating the door plate during night time can be achieved by providing a lighting unit that operates on commercial power sources, the lighting unit as such needs to be electrically connected to an electric power source in the house through a conductive line, which is susceptible to damage after a long period of exposure. The device also needs to be manually switched on during night time and switched off during day time.

SUMMARY OF THE INVENTION

Therefore, the object of the present invention is to provide a door plate assembly with a solar-powered lighting unit so as to overcome the aforesaid drawbacks of the prior art.

According to the present invention, a door plate assembly comprises:

- an upright support unit having a lower end adapted to be disposed on a ground surface;
- a door plate mounted on the upright support unit;
- a lighting unit mounted on the upright support unit and operable so as to generate a light output for illuminating the door plate; and
- a power source mounted on the upright support unit, the power source including a solar panel that is adapted to convert solar energy to electrical energy, a battery unit that is coupled electrically to and that is charged by the electrical energy generated by the solar panel, and a lighting controller connected electrically to the battery unit and the lighting unit, the lighting controller controlling activation of the lighting unit.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
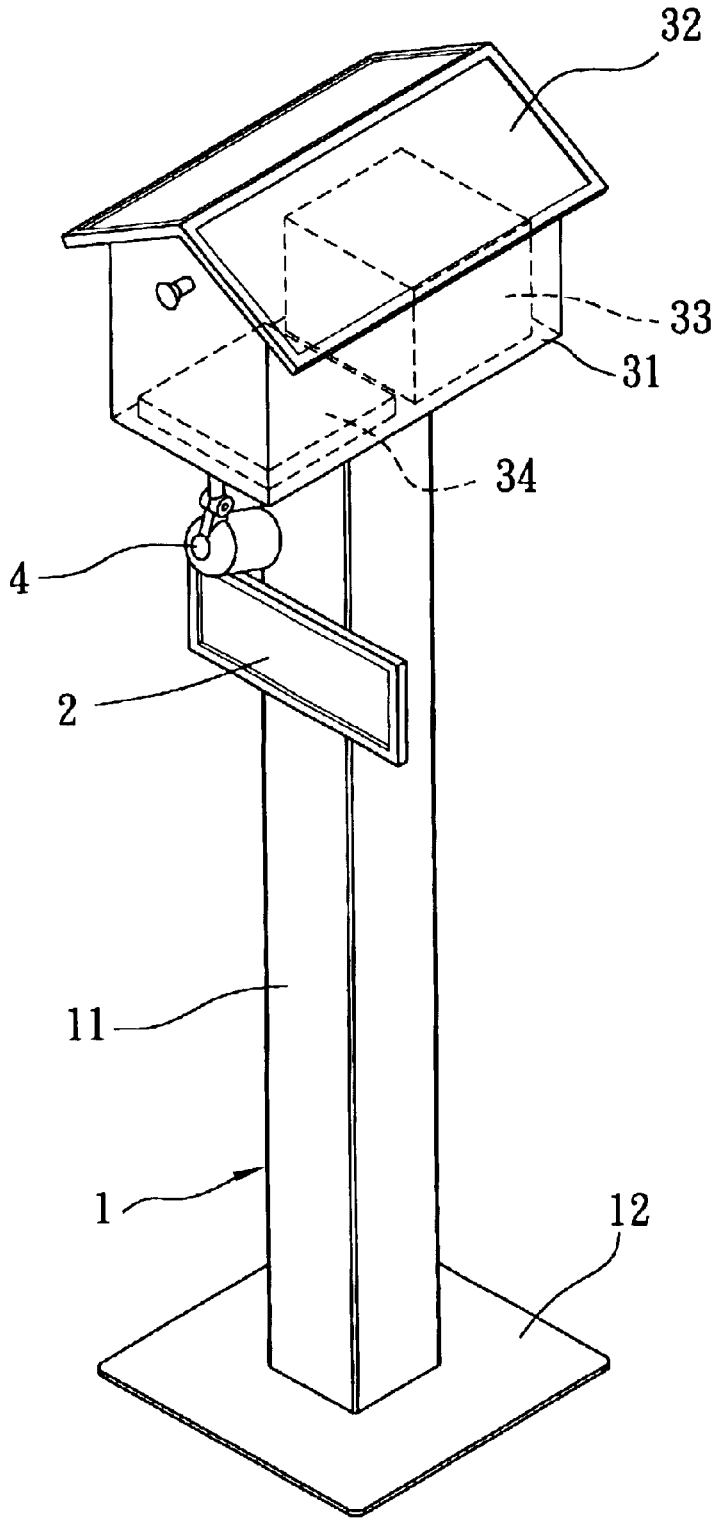
FIG. 1 is a perspective view of the first preferred embodiment of a door plate assembly according to the present invention.

Before the present invention is described in greater detail, it should be noted that like elements are denoted by the same reference numerals throughout the disclosure.

Referring to FIG. 1, the first preferred embodiment of a door plate assembly according to the present invention is shown to comprise an upright support unit 1, a door plate 2, a power source, and a lighting unit 4.

The upright support unit I includes an upright post 11 with a rectangular cross-section. A base plate 12 is secured to a lower end of the upright post 11. By virtue of the base plate 12, the upright support unit 1 can stand stably on the ground surface. The upright post 11 further has an upper portion with a housing 31 mounted thereon.

The door plate 2 is mounted on the upright support unit 1. In this embodiment, the door plate 2 is positioned above a middle portion of the upright support unit 1.

The power source is mounted on the housing 31 and includes a solar panel 32 for converting solar energy into electrical energy in a known manner, a battery unit 33 coupled electrically to the solar panel 32 and charged by the electrical energy generated by the solar panel 32 in a known manner, and a lighting controller 34 coupled electrically to the battery unit 33 and the lighting unit 4 for controlling activation of the lighting unit 4. The solar panel 32 is mounted on the top side of the housing 31, while the battery unit 33 and the lighting controller 34 are disposed within the housing 31. The design of the housing 31 resembles that of a conventional house, and the housing 31 is disposed on the top end of the upright post 11 to maximize exposure of the solar panel 32 to sunlight. The position and construction of the housing 31 in FIG. 1 are solely for illustration and should not be limited thereto. For example, the housing 31 may be configured with a front portion for receiving mail, and a rear portion for receiving the battery unit 33 and the lighting controller 34. Moreover, the number of solar panels 32 may be increased as required.

The light controller 34 employs a photoresistor and functions as an automatic switch that is responsive to ambient light conditions. In daytime, the lighting controller 34 disconnects the battery unit 33 from the lighting unit 4, and allows the solar panel 32 to charge the battery unit 33. However, when the brightness of ambient light falls below a certain threshold, the lighting controller 34 connects the battery unit 33 to the lighting unit 4. As a result, the lighting unit 4 is activated at this time. Since circuit designs for lighting controllers are known to those skilled in the art, a detailed description of the same will be dispensed with herein for the sake of brevity.

The lighting unit 4 is positioned such that the light output thereof is directed toward and illuminates the door plate 2. In this embodiment, the lighting unit is mounted on the bottom side of the housing 31 and is thus disposed above and is vertically spaced apart from the door plate 2.

In the present invention, the illumination produced by the lighting unit 4 ensures that the door plate 2 is visible during night time. Moreover, in view of the power source, the need for a wired connection from a household commercial power source supply electrical energy for operating the lighting unit 4 can be eliminated.

Figure 2:
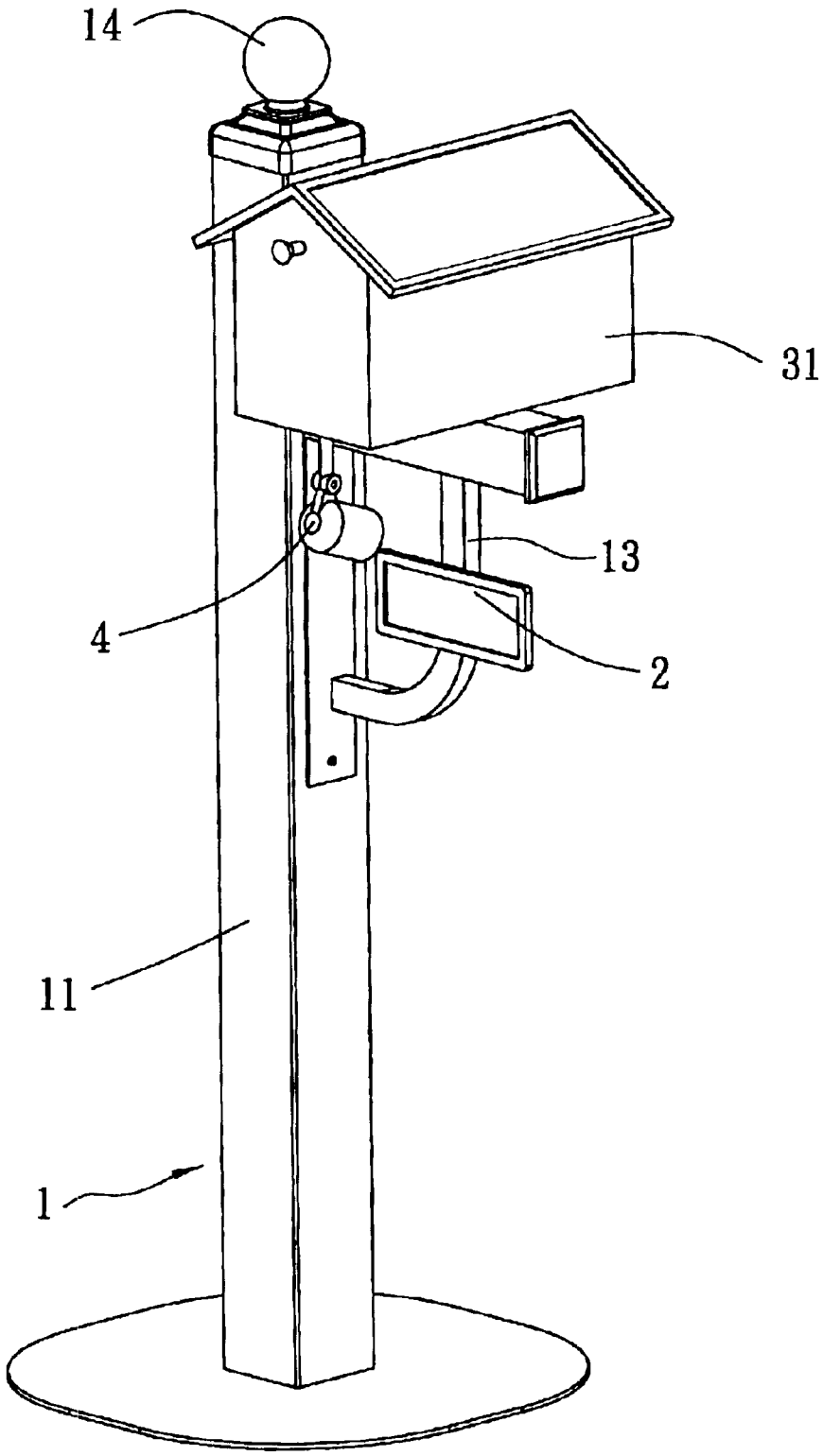
FIG. 2 is a perspective view of the second preferred embodiment of a door plate assembly according to the present invention.
Figure 3:
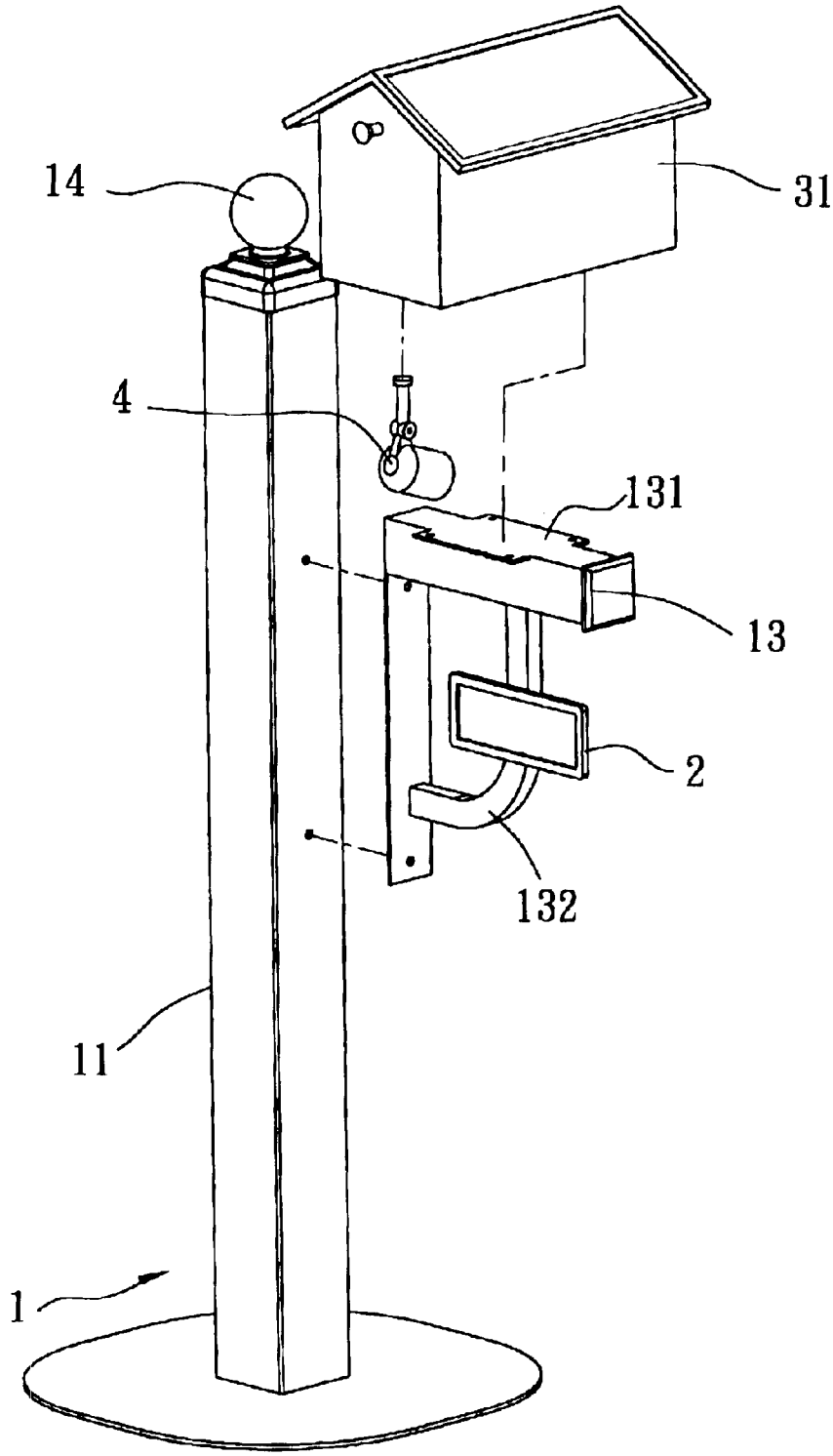
FIG. 3 is an exploded perspective view of the second preferred embodiment.

FIGS. 2 and 3 illustrate the second preferred embodiment of a door plate assembly according to the present invention. When compared to the first preferred embodiment, the upright support unit 1 further includes a bracket 13 mounted on a lateral side of the upright post 11, and an auxiliary lighting member 14 mounted on an upper portion of the upright post 11. The housing 31 is mounted on upper bracket portion 131 of the bracket 13, and the door plate 2 is mounted on a lower bracket portion 132 of the bracket 13. The lighting unit 4 is mounted on the bottom side of the housing 31 and is thus disposed,above and is vertically spaced apart from the door plate 2.The auxiliary lighting member 14 is connected in parallel to the lighting unit 4 so as to operate concurrently therewith.

Figure 4:
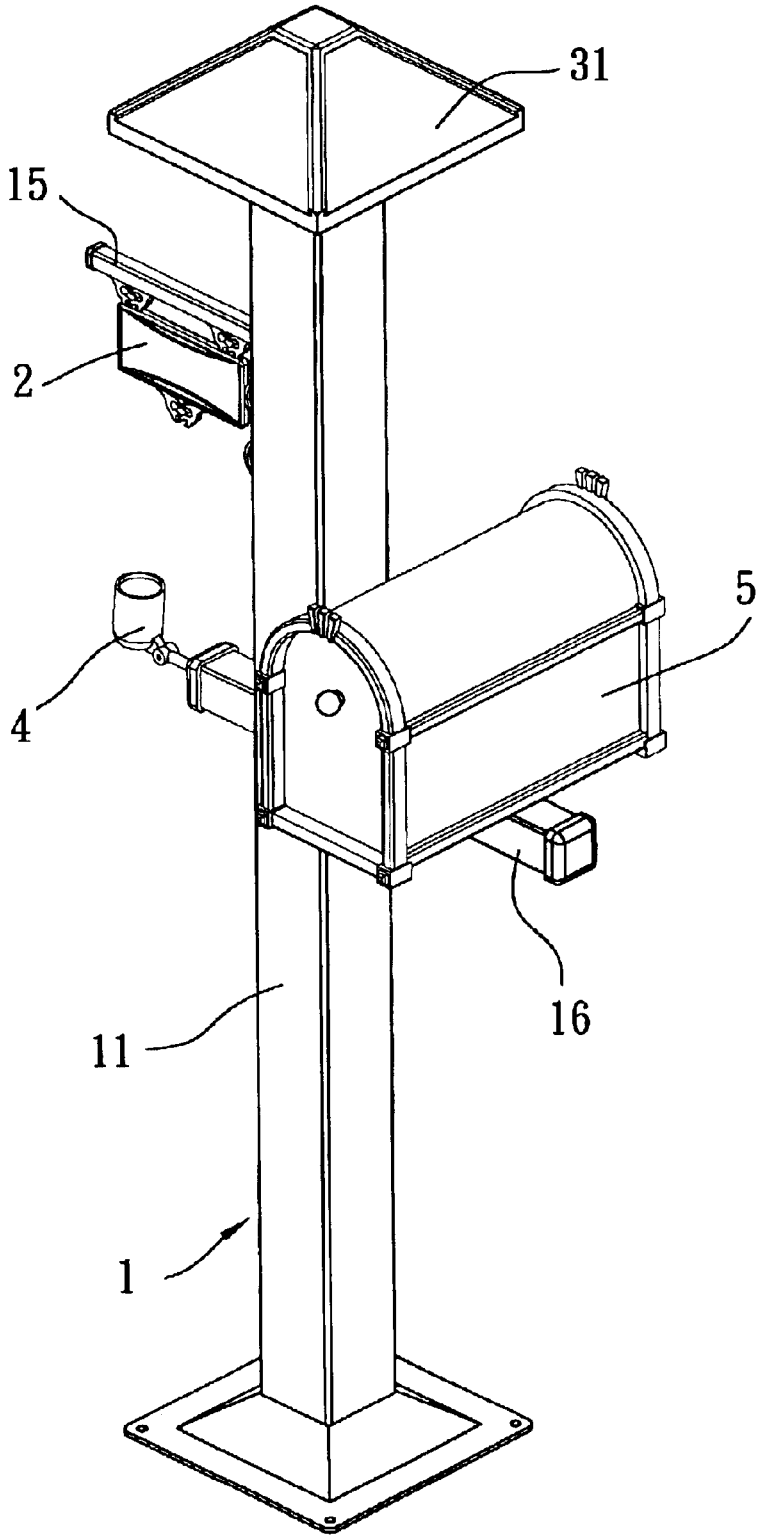
FIG. 4 is a perspective view of the third preferred embodiment of a door plate assembly according to the present invention.

FIG. 4 illustrates the third preferred embodiment of a door plate assembly according to the present invention. When compared to the first and second preferred embodiments, the door plate assembly further includes a mailbox 5, an upper bracket 15, and a lower bracket 16. The upper bracket 15 is mounted on the left side of the upright post 11. The lower bracket 16 is mounted on and extends transverse to the length of the upright post 11. The door plate 2 is hung on the upper bracket 15. The mailbox 5 has a flat bottom secured on the lower bracket 16. The lighting unit 4 is mounted on the lower bracket 16, and is thus disposed below and is vertically spaced apart from the door plate 2. The housing 31 is mounted on an upper end of the upright post 11.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications arrangements.

I claim:

1. A door plate assembly comprising:

an upright support unit having a lower end adapted to be disposed on a ground surface;

a door plate mounted on said upright support unit;

a lighting unit mounted on said upright support unit and operable so as to generate a light output for illuminating said door plate; and a power source mounted on said upright support unit, said power source including a solar panel that is adapted to convert solar energy to electrical energy, a battery unit that is coupled electrically to and that is charged by the electrical energy generated by said solar panel, and a lighting controller connected electrically to said battery unit and said lighting unit, said lighting controller controlling activation of said lighting unit;

wherein said upright support unit includes an upright post with a lateral side, a bracket mounted on said lateral side of said support post, and a housing mounted on said bracket;

said power source being mounted on said housing, said door plate being mounted on said bracket; and wherein said bracket includes upper and lower bracket portions, said housing being mounted on one of said upper and lower bracket portions, said door plate being mounted on the other of said upper and lower bracket portions.

2. The door plate assembly as claimed in claim 1, wherein said lighting unit is mounted on said housing.

3. The door plate assembly as claimed in claim 1, wherein said housing has a top side, said solar panel being mounted on said top side of said housing, said battery unit and said lighting controller being disposed in said housing.

4. The door plate assembly as claimed in claim 1, wherein said upright post further has an upper portion, said door plate assembly further comprising an auxiliary lighting member mounted on said upper portion of said upright post and connected electrically to said lighting unit.

5. A door plate assembly comprising:

an upright support unit having a lower end adapted to be disposed on a ground surface;

a door plate mounted on said upright support unit;

a lighting unit mounted an said upright support unit and operable so as to generate a light output for illuminating said door plate; and a power source mounted on said upright support unit, said power source including a solar panel that is adapted to convert solar energy to electrical energy, a battery unit that is coupled electrically to and that is charged by the electrical energy generated by said solar panel, and a lighting controller connected electrically to sold battery unit and said lighting unit, said lighting controller controlling activation of said lighting unit;

wherein said upright support unit includes an upright post, and upper and lower brackets mounted on said upright post and vertically spaced apart from each other, said door plate being mounted on one of said upper and lower brackets, said lighting unit being mounted on the other of said upper and lower brackets such that the light output thereof is directed vertically toward said door plate.

6. The door plate assembly as claimed in claim 5, wherein said upright post further has an upper end, said upright support unit further including a housing mounted on said upper end of said upright post, said power source being mounted on said housing.

7. The door plate assembly as claimed in claim 6, wherein said housing has a top side, said solar panel being mounted on said top side of said housing, said battery unit and said lighting controller being disposed in said housing.

8. The door plate assembly as claimed in claim 7, further comprising a mailbox mounted on one of said upper and lower brackets.

* * * * *